US008257133B2

(12) United States Patent
Ando et al.

(10) Patent No.: US 8,257,133 B2
(45) Date of Patent: Sep. 4, 2012

(54) TRAVELLING TOY SYSTEM

(75) Inventors: Makoto Ando, Kanagawa (JP); Makoto Nakano, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 1113 days.

(21) Appl. No.: 12/141,496

(22) Filed: Jun. 18, 2008

(65) Prior Publication Data

US 2009/0004948 A1 Jan. 1, 2009

(30) Foreign Application Priority Data

Jun. 19, 2007 (JP) ..... 2007-161377

(51) Int. Cl.
*A63F 13/00* (2006.01)
*A63J 5/02* (2006.01)
*H04N 7/18* (2006.01)

(52) U.S. Cl. ..... 446/175; 446/454; 472/57; 472/60; 348/61

(58) Field of Classification Search ..... 446/175, 446/454–456; 472/57–60; 463/30–31; 104/83–85
See application file for complete search history.

(56) References Cited

U.S. PATENT DOCUMENTS 4,986,187 A * 1/1991 Booth et al. ..... 104/84
2001/0045978 A1* 11/2001 McConnell et al. ..... 348/42
2003/0071910 A1* 4/2003 Tomita ..... 348/367
2003/0190856 A1* 10/2003 Peters ..... 446/175
2005/0264679 A1 12/2005 Sasaki et al.
2006/0293102 A1* 12/2006 Kelsey ..... 463/37
2007/0078013 A1* 4/2007 Simmons ..... 472/60
2007/0106484 A1* 5/2007 Sweatman et al. ..... 702/188
2007/0227274 A1* 10/2007 Verl et al. ..... 73/865.9

FOREIGN PATENT DOCUMENTS

| | | |
|---|---|---|
| JP | 07-178235 | 7/1995 |
| JP | 2001-358984 | 12/2001 |
| JP | 2002-045579 | 2/2002 |
| JP | 2005-198268 | 7/2005 |
| JP | 2005-338352 | 12/2005 |
| JP | 2006-204491 | 8/2006 |
| JP | 2006-279648 | 10/2006 |
| JP | 2007-075495 | 3/2007 |

* cited by examiner

*Primary Examiner* — Dmitry Suhol
*Assistant Examiner* — Alex F. R. P. Rada, II
(74) *Attorney, Agent, or Firm* — Rankin, Hill & Clark LLP

(57) ABSTRACT

A traveling toy system is provided, in which it becomes possible to reduce the amount of information transmitted to a video display device. In the traveling toy system, a video camera, a video camera controller which is adjustably controls at least a frame rate of the video camera, a signal transmission device which transmits a video signal outputted from the video camera to a video display device, and electric storage means for power supply are mounted on the traveling toy which travels on a traveling lane using a potential energy. The traveling toy system further includes a traveling toy carrier device which carries the traveling toy from a position where the potential energy is low to a position where the potential energy is high. The video camera controller changes the frame rate so that when a traveling speed of the traveling toy is higher than a given speed, the frame rate may be increased from the frame rate at the time that the traveling speed is lower than the given speed.

15 Claims, 17 Drawing Sheets

*Fig.7*

| Speed Reference Level Range | Frame Rate | Resolution |
|---|---|---|
| Low | Low | High |
| High | High | Low |

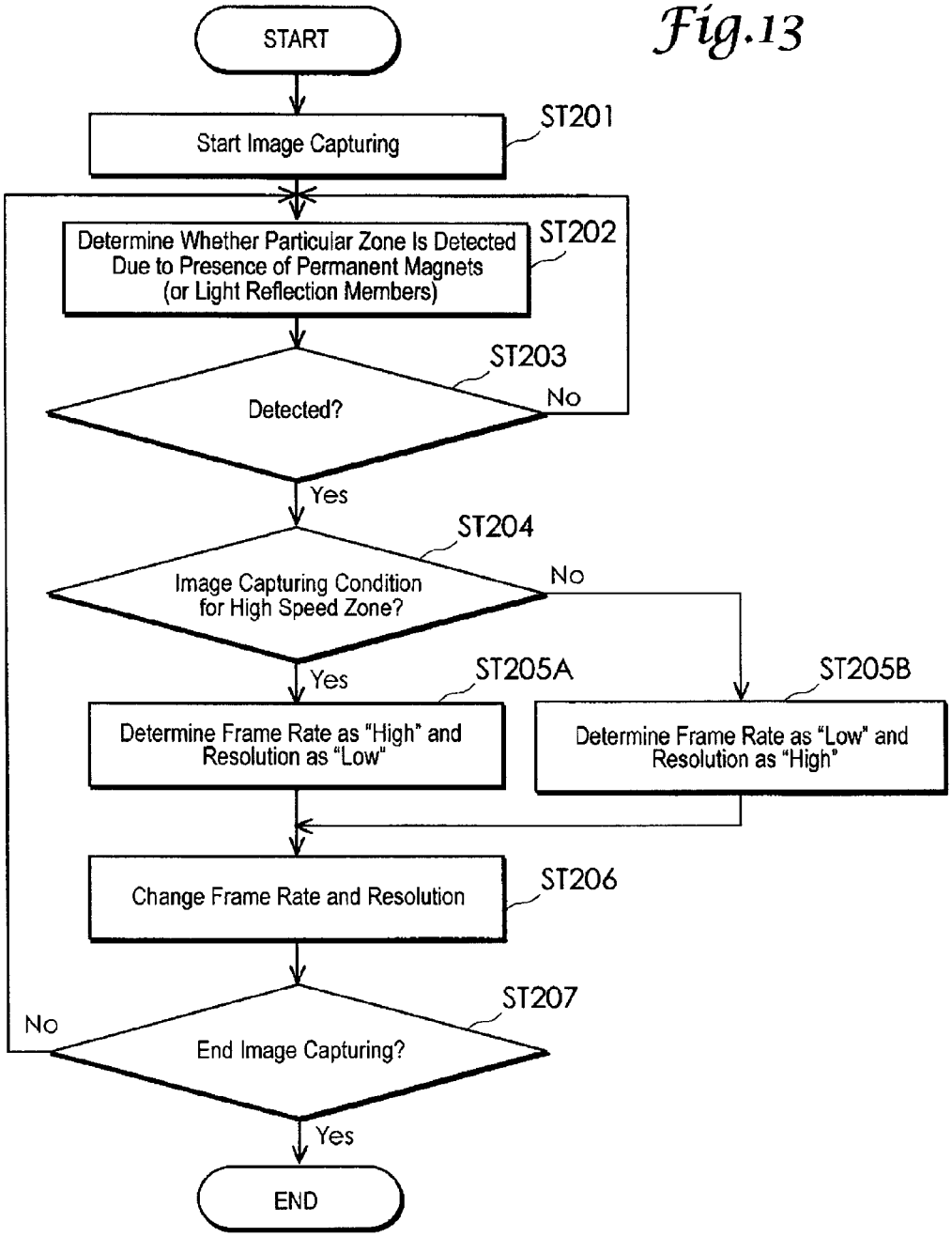
Fig.13
START
Start Image Capturing
ST201
Determine Whether Particular Zone Is Detected Due to Presence of Permanent Magnets (or Light Reflection Members)
ST202
Detected?
ST203
No
Yes
Image Capturing Condition for High Speed Zone?
ST204
No
Yes
ST205A
Determine Frame Rate as "High" and Resolution as "Low"
ST205B
Determine Frame Rate as "Low" and Resolution as "High"
Change Frame Rate and Resolution
ST206
End Image Capturing?
ST207
No
Yes
END

TRAVELLING TOY SYSTEM

BACKGROUND OF THE INVENTION

The present invention relates to a traveling toy system which displays images captured with a video camera, which is installed in a traveling toy that travels using a potential energy, on a video display device.

Japanese Patent Application Publication No. 2006-279648 (JP2006-279648A) discloses a toy system in which a video camera, which is installed in a traveling toy operated by remote control, captures an image and transmits it to a video display device via the Internet so that the operator of the system can view the image captured by the video camera.

In conventional traveling toy systems, images displayed on the video display device are captured at a fixed frame rate irrespective of the traveling speed of the traveling toy. When the traveling speed of the traveling toy does not vary so much, the image quality displayed on the video display device is almost stable even if the traveling speed of the traveling toy is changed. Accordingly, viewers do not feel something strange. However, if the frame rate (the number of frames per second) of the video camera is determined based on the condition that the traveling speed of the traveling toy is low even though the variation in the traveling speed is large, when the traveling speed of the traveling toy is high, the motion of image display is not so smooth compared with when the traveling speed of the traveling toy is low. Namely, the motion of pictures (objects to be captured such as an ambient view around) may be viewed discontinuously as if advanced frame-by-frame. In particular, since the objects to be captured by such toy are in many cases household utensils of daily use installed in the room and are not a vast and vague landscape as seen from a real vehicle, viewers are very likely to feel something strange. Accordingly, it has been difficult for a traveling toy system to make viewers feel as if they were really riding on the traveling toy.

When the frame rate is determined based on the frame rate at the time that the traveling speed of the traveling toy is high, viewers can enjoy smooth images without feeling something strange whether the motion of the traveling toy is slow or fast. However, in this situation, motion pictures taken at a high frame rate must be always displayed even when the traveling speed of the traveling toy is low, which means a large amount of information is always transmitted to the video display device. As a result, there is a problem with an increased total amount of power consumption. To solve the problem, it is necessary to mount a large-capacity electric storage means for power supply onto the traveling system, which makes the toy more expensive.

SUMMARY OF THE INVENTION

It is an object of the present invention to provide a traveling toy system in which a smooth motion picture can be displayed so as not to make viewers feel something strange even when there is large variation in the traveling speed of the traveling toy on which the video camera is mounted, and electric power consumption in total can be reduced.

Another object of the present invention is to provide a traveling toy system in which the amount of information transmitted to a video display device can be reduced.

A further object of the present invention is to provide a traveling toy system in which data volume of a video signal transmitted to a video display device can be suppressed even when the frame rate of a video camera is changed.

Still another object of the present invention is to provide a traveling toy system in which electric storage means for power supply of a traveling toy can be charged while a traveling toy carrier device is carrying a traveling toy.

A traveling toy system of the present invention includes a traveling toy. The traveling toy which travels on a traveling lane using a potential energy includes a video camera, a video camera controller which adjustably controls at least a frame rate of the video camera, a signal transmission device which transmits a video signal outputted from the video camera to a video display device, and electric storage means for power supply. The traveling toy system of the present invention also includes a traveling toy carrier device which carries the traveling toy from a position where the potential energy is low to a position where the potential energy is high.

The video camera controller changes the frame rate so that when a traveling speed of the traveling toy is higher than a given speed, the frame rate may be increased from the frame rate at the time that the traveling speed is lower than the given speed. With such configuration, when the traveling toy travels at the higher traveling speed, image capturing is conducted at a frame rate that is appropriately adjusted to the higher traveling speed and when the traveling toy travels at lower speed, the frame rate is decreased from that for the higher traveling speed so as to be more appropriate to the lower traveling speed. Accordingly, smooth motion pictures are available even when the traveling toy is traveling at a speed higher than the given speed as with when the traveling toy is traveling at a speed lower than the given speed. Moreover, it becomes possible to control the amount of information which is included in the video signal transmitted from the signal transmission device, in accordance with the traveling speed of the traveling toy so that power consumption can be reduced in total. As a result, when using a non-rechargeable primary battery as the electric storage means for power supply, it is possible to extend its battery life. When using a rechargeable secondary battery or capacitor as the electric storage means for power supply, it becomes possible to decrease capacitance and charging time of the electric storage means for power supply.

The type of the electric storage means for power supply is arbitrary if only it can supply electric power at least to the video camera, signal transmission means and the video camera controller as mentioned below, and may be the primary battery, a secondary battery or the capacitor as mentioned above.

The image capturing direction of the video camera is arbitrary. For example, the video camera may be attached on the front face of the traveling toy so that a landscape ahead in the forward traveling direction of the traveling toy can be captured, or it may be attached to the rear face of the traveling toy so that a landscape behind the traveling toy can be captured. The video camera may be either of a non-zooming type or a zooming type. Further, the video camera may be configured so that the image capturing direction can be adjusted by the video camera controller.

The video camera controller may be of any type as far as it increases the frame rate when the traveling speed of the traveling toy is higher than the given speed. For example, the video camera controller may include a speed sensor which detects the traveling speed of the traveling toy and an image capturing condition changing section which changes the frame rate in accordance with an output of the speed sensor. In this configuration, the image capturing condition changing section includes reference level determination means for determining which level range, among a plurality of predetermined reference level ranges, the speed detected by the speed sensor belongs to, and image capturing condition changing means for changing at least the frame rate in accordance with a determination made by the reference level determination means. The image capturing condition changing means changes the frame rate when the speed detected by the speed sensor comes to belong to a higher reference level range than the previous reference level range so that the frame rate may be increased from that for the previous lower reference level range. Here, the relationship of the higher reference level range and the lower reference level range is that speeds belonging to the higher reference level range are higher than those belonging to the lower reference level range.

In such a situation, it is preferred that the frame rate for each of the plurality of reference level ranges is defined so that an image displayed on the video display device may not make viewers feel something strange. The reference level range may be classified into two, a high reference level range and a low reference level range, or may be classified into many more level ranges. When the reference level range is classified more finely, it becomes possible to make displayed motion pictures smooth enough so that viewers may not feel something strange even when the traveling speed of the traveling toy including the video camera changes so much.

It may be determined which speed range the traveling speed of the traveling toy belongs to by detecting a position (traveling zone) of the traveling toy traveling on the traveling lane. In this configuration, the traveling toy system further includes zone detection means for detecting a high speed zone in which the traveling speed of the traveling toy is higher than the given speed and a low speed zone in which the traveling speed is lower than the given speed, based on a position of the traveling toy traveling on the traveling lane. The zone detection means includes a zone identification portion which is disposed on the traveling lane and identifies either of the high speed zone or the low speed zone, and zone determination means which is mounted on the video camera controller for determining whether or not the traveling toy is traveling within the zone identified by the zone identification portion. The video camera controller further includes an image capturing condition changing section which determines whether or not the traveling speed of the traveling toy is higher than the given speed in accordance with the zone determined by the zone determination means, and changes the frame rate.

The zone identification portion and the zone determination means may be arbitrarily configured, as far as they are capable of detecting a position of the traveling toy traveling on the traveling lane and determining whether the traveling toy is traveling in the high speed zone or the low speed zone of the traveling lane. For example, the zone identification portion is constituted from two or more permanent magnets disposed on at least both ends of the high speed zone or the low speed zone. In this configuration, the zone determination means includes a hall element which detects the presence of the two or more permanent magnets, and determines whether the traveling toy is traveling in the high speed zone or the low speed zone of the traveling lane, based on an output of the hall element. Alternatively, the zone identification portion may be constituted from two or more light reflection members disposed on at least both ends of the high speed zone or the low speed zone. In this configuration, the zone determination means includes a light-emitting element which emits light to the traveling lane and a light-receiving element which receives the light reflected by the light reflection member to detect the presence of the two or more light reflection members, and determines whether the traveling toy is traveling in the high speed zone or the low speed zone of the traveling lane, based on an output of the light-receiving element. The zone identification portion may be constituted from a mark indicator provided in the high speed zone and/or the low speed zone of the traveling lane. In this configuration, the zone determination means includes image recognition means for recognizing the presence of the mark indicator based on the video signal transmitted from the video camera, and determines whether the traveling toy is traveling in the high speed zone or the low speed zone of the traveling lane, based on an output of the image recognition means. With such configuration, it becomes possible to change the frame rate with certainty only by the traveling toy entering a predetermined zone. Even in this configuration, the frame rates for the high speed zone and the low speed zone may be defined respectively so that an image displayed on the video display device may not make viewers feel something strange.

The type of the traveling toy carrier device is arbitrary as far as it carries the traveling toy from a position where the potential energy is low to a position where the potential energy is high. For example, it may be disposed somewhere in the traveling lane and equipped with an independent driving source for carrying the traveling toy. For example, the traveling toy carrier device may include a charging device which supplies electric power for charging the electric storage means for power supply while carrying the traveling toy to the position where the potential energy is high. In this configuration, the traveling toy carrier device includes output electrodes which output the electric power from the charging device, and the traveling toy includes charging electrodes and a charging circuit so that the charging electrodes may be connected to output electrodes of the charging device and the charging circuit may charge the electric storage means for power supply with electric power supplied from the charging device. With such configuration, the electric storage means for power supply can be charged while the traveling toy is carried to the position where the potential energy is high. Since the electric storage means for power supply can be charged every time the traveling toy is carried in this manner, it becomes possible to use low capacitance electric storage means for power supply. That contributes to curtailing the price of the system. In addition, there is another advantage that it is not necessary to stop the operation of the traveling toy system each time the electric storage means for power supply is charged.

When the traveling toy carrier device is configured to charge the electric storage means for power supply while carrying the traveling toy to the position where the potential energy is high, it is preferred that the traveling toy system further includes zone detection means for detecting a high speed zone in which the traveling speed of the traveling toy is higher than the given speed and a low speed zone in which the traveling speed is lower than the given speed, based on a position of the traveling toy traveling on the traveling lane. In this configuration, the zone detection means includes zone determination means which is mounted on the video camera controller for detecting whether the traveling toy is traveling in the high seed zone or the low speed zone by determining whether or not the charging electrodes of the traveling toy are connected to the output electrodes of the charging device. The video camera controller further includes the image capturing condition changing section which determines whether or not the traveling speed of the traveling toy is higher than the given speed in accordance with the zone determined by the zone determination means, and changes the frame rate. In this configuration, charging may be defined as being performed within the low speed zone. Therefore, the low speed zone can easily be detected simply by detecting whether or not charging is being performed. As a result, the frame rate can be changed with certainty. Further, since the frame rate is decreased while the traveling toy is being carried and charged by the traveling toy carrier device, electric power consumption can be reduced and sufficient charging can be performed.

The traveling toy carrier device may be mounted onto the traveling toy. In this configuration, a motor is mounted on the traveling toy as the traveling toy carrier device so that the traveling toy can be self-activated from the position where the potential energy is low to the position where the potential energy is high by driving the motor.

In a configuration where the traveling toy carrier device includes an entrance portion and an exit portion, the traveling lane may be continuously formed between the entrance portion and the exit portion of the traveling toy carrier device so as to allow the traveling toy to start traveling from the exit portion and return to the entrance portion only by means of the potential energy. With such configuration, the traveling toy can continue to travel on the traveling lane and continue to transmit a video signal unless any external force is applied to stop the motion of the traveling toy. Accordingly, viewers do not have to move the traveling toy.

The signal transmission device may include resolution changing means for changing a video signal resolution in accordance with the frame rate. In this configuration, the resolution changing means changes the resolution by decreasing the video signal resolution when the frame rate is increased and by increasing the resolution when the frame rate is decreased. The amount of information (data volume) to be transmitted is defined by the product of the frame rate and resolution. Accordingly, when the resolution is changed as described above, the data volume to be transmitted is suppressed even when the frame rate is increased. That can prevent the size of data transmitted by the signal transmission device from becoming too large, thereby contributing to reducing power consumption. When the frame rate is high, a display time per frame becomes shorter than when the frame rate is low. Accordingly, when the frame rate is high, viewers rarely feel something strange even when the video signal resolution is low or image display is somewhat coarse. Further, if the resolution of images captured by the video camera is adjustable, the video camera controller may be configured to be capable of changing the resolution of images captured by the video camera instead of providing the signal transmission apparatus with the resolution changing means.

The video display device can be configured arbitrarily. When the traveling toy system includes a dedicated controller, the video display device may be mounted on the dedicated controller. With such configuration, it becomes possible for viewers to operate the dedicated controller while viewing the image captured by the traveling toy. Therefore, more reliable operation may be attained. The video display device may include a monitor and a reproduction device which reproduces the video signal on the monitor. With such configuration, it becomes possible to view the motion pictures by using what is called home video-game device as a receiver and a general-purpose monitor as a video signal display. What is controlled by the dedicated controller may be the motion of the traveling toy, or the game contents when images captured by the traveling toy are used.

According to the traveling toy system of the present invention, since the frame rate of the image captured by the video camera, which is mounted on the traveling toy, is changed in accordance with the traveling speed of the traveling toy, a smooth motion picture may be displayed in such a manner that viewers may not feel something strange. Moreover, it is also possible to provide a traveling toy system in which power consumption can be reduced in total.

BRIEF DESCRIPTION OF THE DRAWINGS

FIG. 7 shows a relationship among a frame rate, resolution, and reference level ranges.

FIG. 13 is a flow chart showing a program algorithm for implementing the signal processing circuit of FIG. 12.

DETAILED DESCRIPTION OF THE PREFERRED EMBODIMENTS

Figure 1:
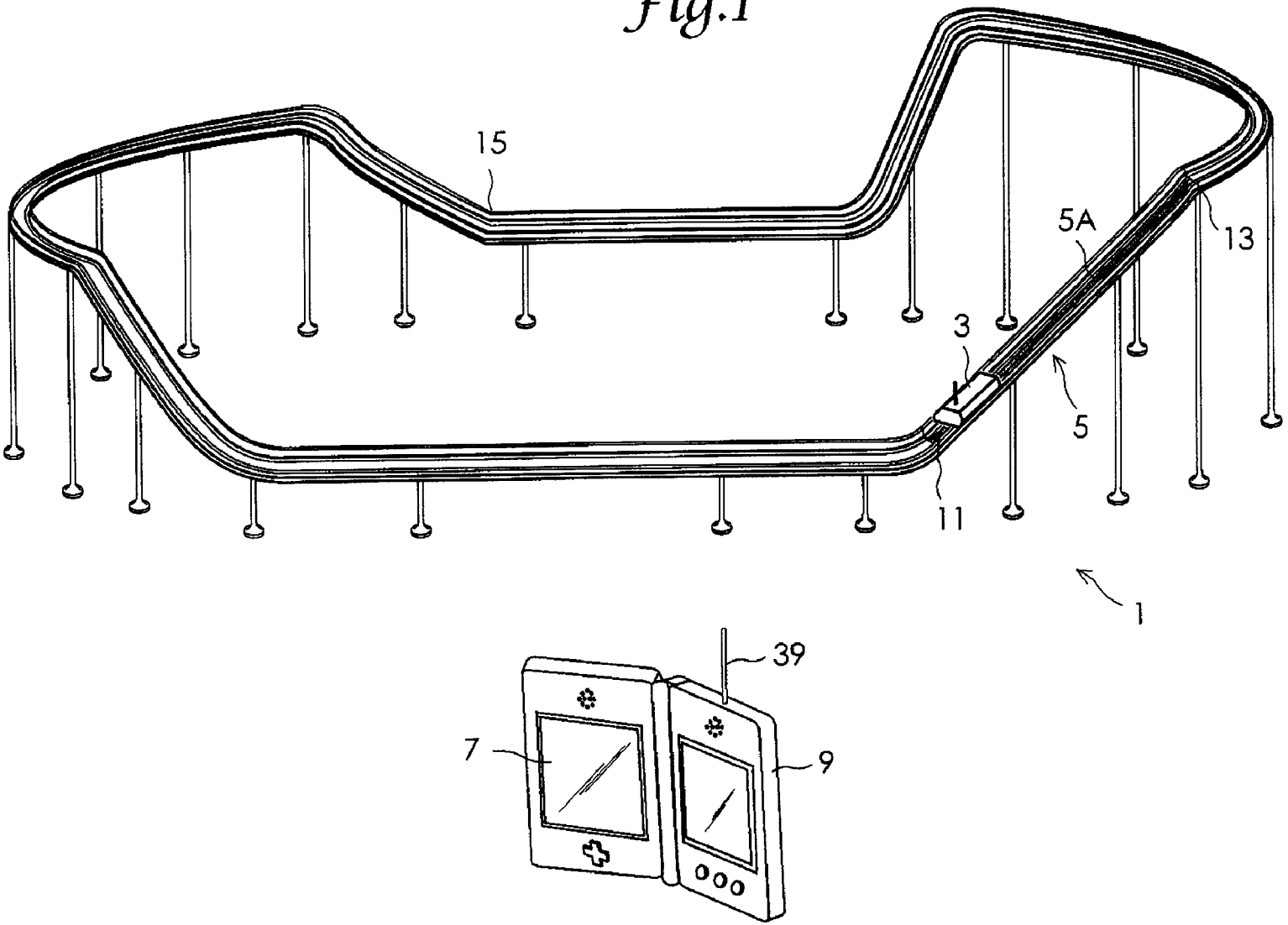
FIG. 1 shows a traveling toy system according to one embodiment of the present invention.
Figure 2A:
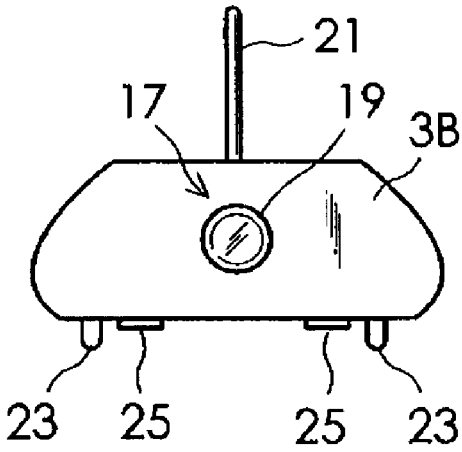
FIGS. 2A, 2B, 2C and 2D are a front elevation view, a right side elevation view, a bottom view, and a perspective view of the traveling toy which may be used in the embodiment of FIG. 1.
Figure 2B:
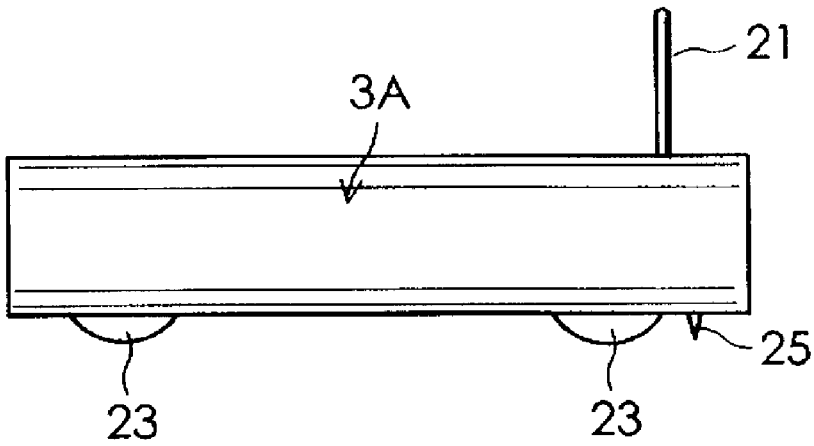
Figure 2C:
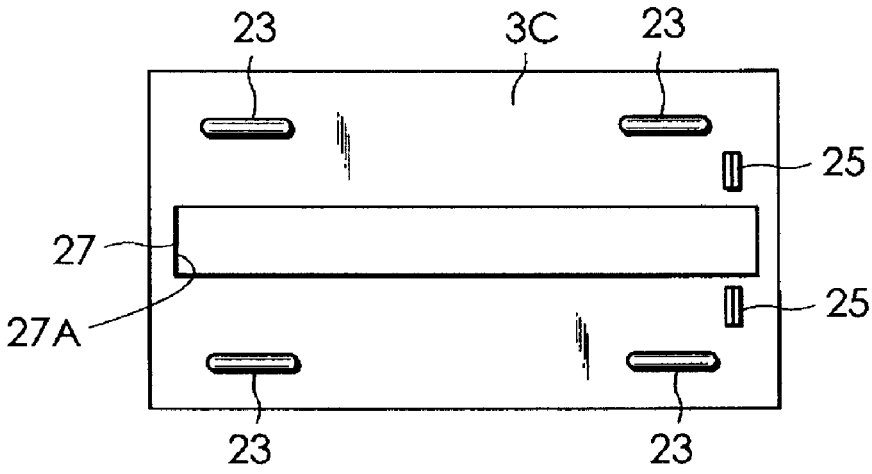
Figure 2D:
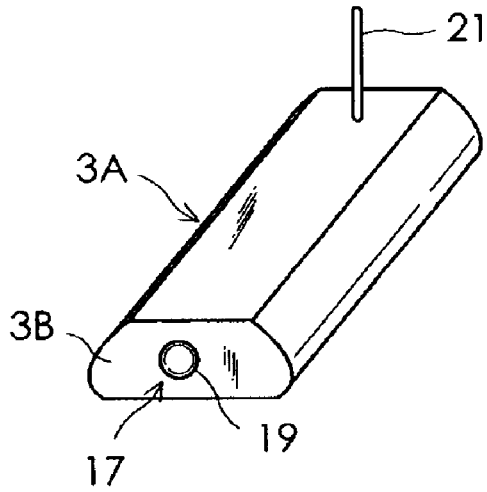

Preferred embodiments of the present invention will now be described hereinbelow with reference to the drawings FIG. 1 shows a traveling toy system according to one embodiment of the present invention. The traveling toy system 1 comprises a traveling toy 3, a traveling toy carrier device 5, a dedicated controller 9 equipped with a display screen 7, and a traveling lane 15. In this embodiment, the traveling toy carrier device 5 is arranged separately from the traveling toy 3 so as to constitute a part of the traveling lane 15. The traveling toy carrier device 5 includes an entrance portion 11 through which the traveling toy 3 enters and an exit portion 13 through which the traveling toy 3 returns the traveling lane. In FIG. 1, only a carrier portion 5A of the traveling toy carrier device 5 is shown and a driving portion for applying a driving force to the carrier portion 5A is not illustrated. The traveling toy carrier device 5 carries the traveling toy 3 from the entrance portion 11, through which the traveling toy 3 has entered, to the exit portion 13 in which the potential energy of the traveling toy 3 increases. Accordingly, the carrier portion 5A of the traveling toy carrier device 5 shown in FIG. 1 partially constitutes the traveling lane 15 of the traveling toy system 1.

FIG. 2 shows an example of the traveling toy 3 applied to the present embodiment, and FIGS. 2A, 2B, 2C and 2D are a front elevation view, a right side elevation view, a bottom view, and a perspective view thereof, respectively. A video camera 17 is installed in a toy body portion 3A of the traveling toy 3. The body of the video camera 17 is disposed inside the toy body portion 3A and lens 19 thereof is exposed from a front end face 3B of the toy body portion 3A. An antenna 21 for transmitting/receiving a signal to/from the dedicated controllers 9 is attached to the rear end of the toy body portion 3A. Each of four wheels 23 for advancing the traveling toy 3 is partially exposed from a bottom face 3C of the toy body portion 3A. A pair of collector brushes 25 which are electrically connected to an after-mentioned charging device are exposed from the bottom face 3C. The pair of collector brushes 25 constitute charging electrodes 61 as explained in FIG. 5. A hole 27 including an engaged portion 27A is provided in the bottom face 3C so as to be engaged with a protrusion 37 of the carrier portion 5A of the traveling toy carrier device 5 (refer to FIG. 3A).

The configuration of the video camera 17 is arbitrary, and may be a small video camera whose imaging means is a CCD camera as generally used in portable telephones or the like. It is necessary that the video camera 17 should have a function of changing at least a frame rate. Such video camera 17 can change the frame rate based on an image capturing condition changing command given by a video camera controller 41 (refer to FIG. 5) disposed inside the traveling toy 3. The video camera 17, upon capturing a target (object to be captured) at a given frame rate, converts the captured image data into a video signal. The video signal outputted from the video camera 17 is processed by a signal processing circuit disposed inside the traveling toy 3 and transmitted to a signal transmission device 43 (refer to FIG. 5) as mentioned below. The signal transmission device 43 provided in the traveling toy 3 then transmits the converted video signal to the dedicated controller 9 which is equipped with the display screen 7, via the antenna 21 attached to the traveling toy 3.

The wheels 23, which are exposed from the bottom face 3C of the traveling toy 3, are in contact with a running surface of the traveling lane 15. On a down-slope of the traveling lane 15, the wheel 23 rotates by friction by means of the potential energy so that the traveling toy 3 can travel smoothly along the traveling lane 15. As will be described in detail with reference to FIG. 5, the traveling toy 3 includes therein various kinds of electric circuit components such as electric storage means for power supply 65, a charging circuit 63 which charges the electric storage means 65 for power supply, a speed sensor 45 and the video camera controller 41. The speed sensor 45 (refer to FIG. 5), which outputs a signal in proportion to the traveling speed of the traveling toy 3, typically include an optical/magnetic encoder which measures the number of rotations of the axle to which the wheel 23 is fixed, and a speed sensor of a type which outputs a speed signal by integrating an output from an acceleration sensor.

Figure 3A:
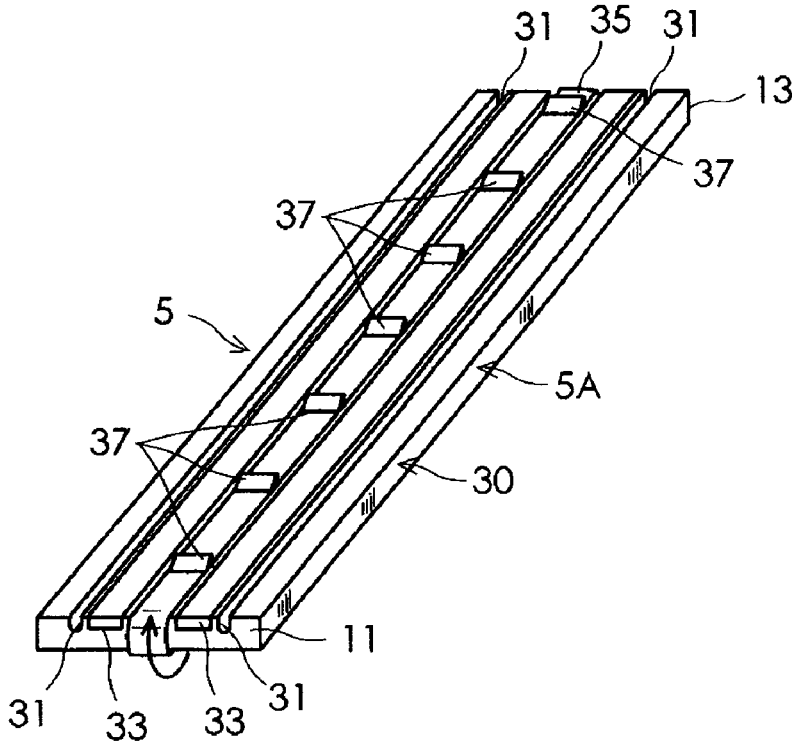
FIG. 3A is a detailed perspective view of a traveling toy carrier device shown in FIG. 1.
Figure 3B:
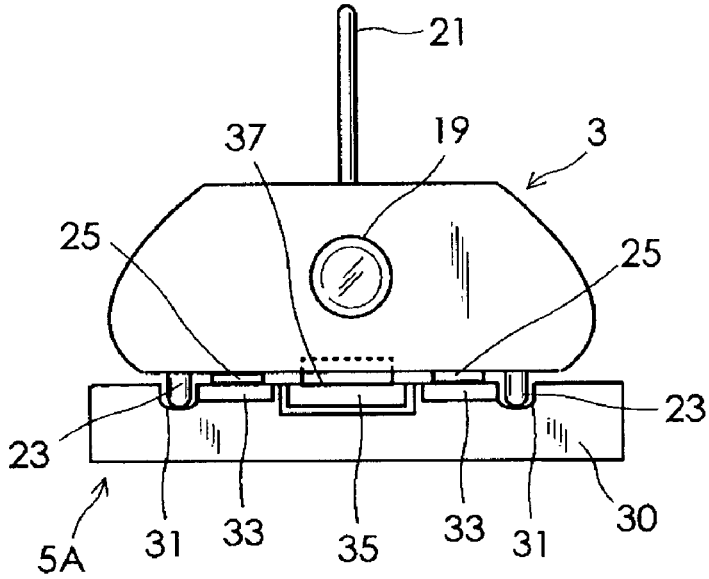
FIG. 3B is a front elevation view showing that the traveling toy has entered the carrier device.
Figures 4A, 4B, 4C, 4D:
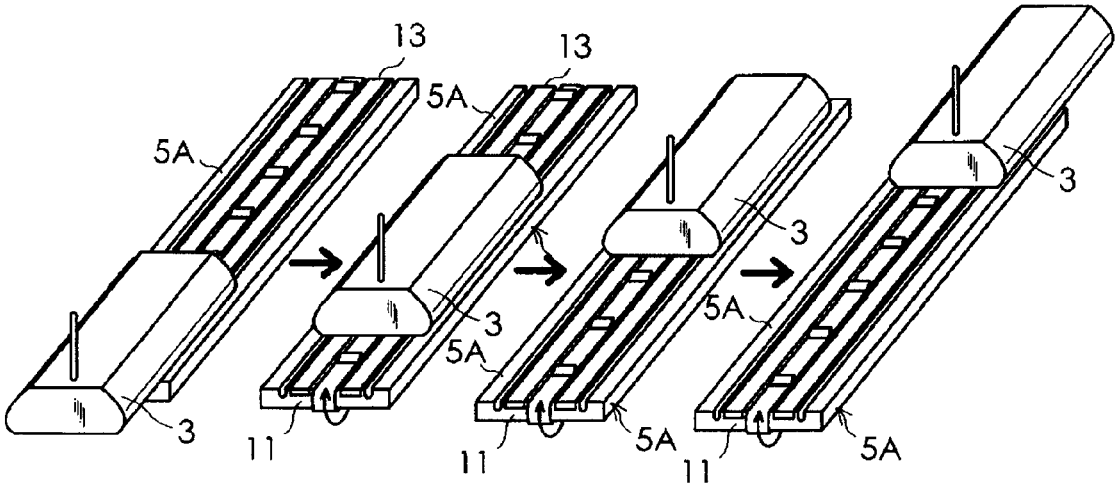
FIGS. 4A to 4D show how the traveling toy carrier device of FIG. 1 is carrying the traveling toy which has entered the carrier device.

FIG. 3A is an enlarged perspective view of the carrier portion 5A of the traveling toy carrier device 5, which is applicable to the present embodiment. FIG. 3B is a front elevation view showing that the traveling toy 3 has entered the carrier portion 5A.

FIGS. 4A to 4D show how the carrier portion 5A of the traveling toy carrier device 5 carries the traveling toy 3 to the position where the potential energy is high. The carrier portion 5A of the traveling toy carrier device 5 carries the traveling toy 3 from the entrance portion 11 to the exit portion 13. The carrier portion 5A has a pair of wheel receiving grooves 31 for receiving the wheels 23 of the traveling toy 3. The receiving grooves 31 are formed on the surface of a plate-like base 30 and extending in the longitudinal direction of the base 30 or along the both ends, as viewed in the width direction, of the base 30. A pair of power supply rails 33 are arranged on the surface of the base 30 between the pair of wheel receiving grooves 31 and extending along the pair of wheel receiving grooves 31. A pair of collector brushes 25 provided in the traveling toy 3 are in contact with the pair of power supply rails 33 to receive direct current power supplied from a direct current power supply, not shown, while the traveling toy 3 is being carried on and along the carrier portion 5A. The configuration and quality of component materials of the pair of collector brushes 25 and the pair of power supply rails 33 are chosen so that the end of the collector brush 25 can securely be in contact with the pair of power supply rails 33 so that charging can be conducted without fail while the traveling toy 3 is being carried. However, the collector brush 25 is further configured so as not to be in contact with the surface of the traveling lane 15 when the traveling toy 3 traveling on the traveling lane is traveling on a zone other than the carrier portion 5A of the traveling toy carrier device 5. An escalator 35, which is constituted from a rubber endless belt, is provided in the center of the base 30 between the pair of power supply rails 33 so that it can turn about the base 30 in its longitudinal direction. The escalator 35 has a plurality of protrusions 37 which are integrally formed on the surface thereof at a regular interval in the longitudinal direction so as to engage with the engaged portion 27A, which is formed in one inner end of the hole 27 provided in the traveling toy 3. The escalator 35 is driven by a driving device, not shown, which is disposed under the carrier portion 5A and rotatably drives the escalator 35 by engaging with the protrusion 37 of the escalator 35. When the protrusion 37 moves to the exit portion 13 from the entrance portion 11 along with the rotation of the escalator 35, the traveling toy 3, in which the engaged portion 27A is engaged with the protrusion 37, is thereby moved along the base 30. In this manner, the traveling toy 3 is carried on the carrier portion 5A from the position where the potential energy is low (entrance portion 11) to the position where the potential energy is high (exit portion 13). The configuration of the traveling toy carrier device 5 is not limited to that as described in the present embodiment.

Figure 5:
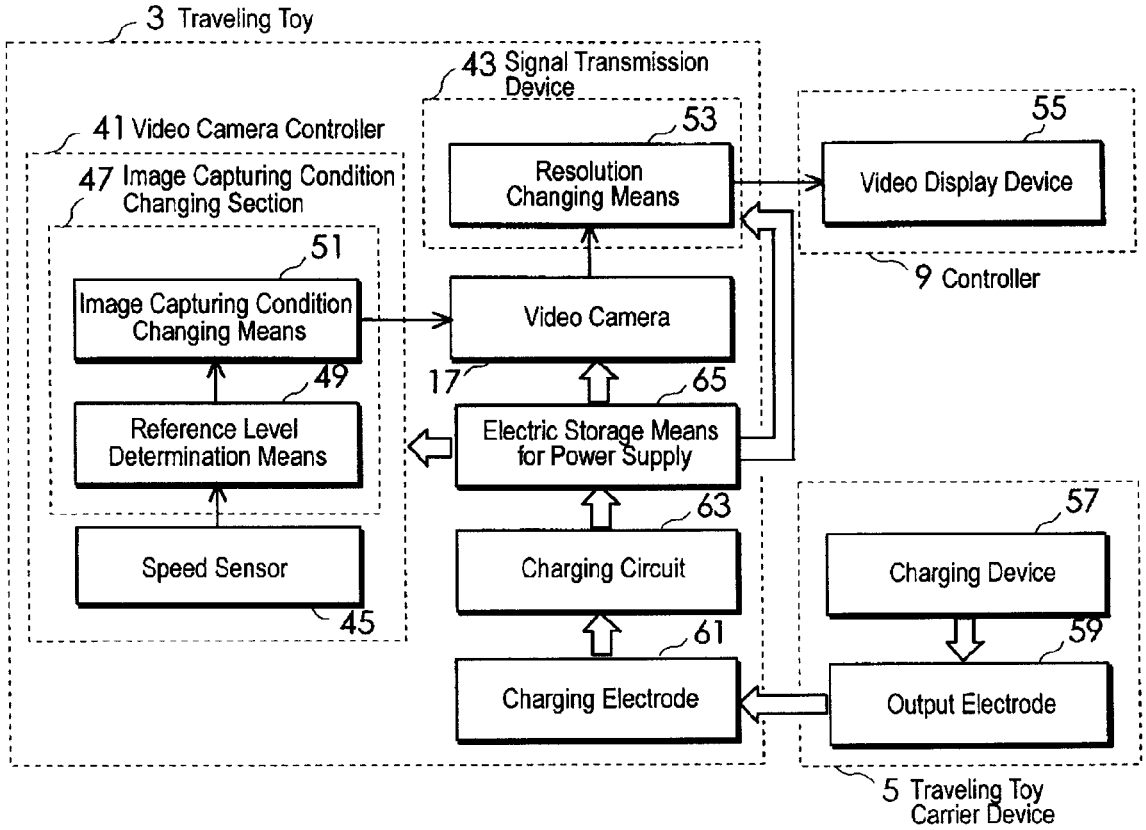
FIG. 5 is a block diagram partially showing an example configuration of a signal processing circuit and a flow of electric power according to the embodiment of FIG. 1.

FIG. 5 is a block diagram showing various kinds of means constituting a signal processing circuit as shown in the embodiment of FIGS. 1 to 4, which are disposed in three parts, the traveling toy 3, the traveling toy carrier device 5, and the dedicated controller 9, and also showing flows of a signal and electric power within the traveling toy system 1 according to the present embodiment. Here, thin arrows represent the signal flow, and bold arrows represent the power flow. The signal processing circuit of the present embodiment is configured in such a manner that at least the video camera 17, the video camera controller 41, and the signal transmission device 43 are included in the traveling toy 3.

The video camera controller 41 includes at least the speed sensor 45 and an image capturing condition changing section 47. The image capturing condition changing section 47 includes at least reference level determination means 49 and image capturing condition changing means 51. In the present embodiment, the signal transmission apparatus 43 includes resolution changing means 53. The dedicated controller 9 includes at least a video display device 55.

The video camera controller 41 measures the traveling speed of the traveling toy 3 with the speed sensor 45, and changes the image capturing condition of the video camera 17 based on the measurement result through the image capturing condition changing section 47. The speed sensor 45 measures the traveling speed of the traveling toy 3, and outputs the measurement result to the reference level determination means 49 of the image capturing condition changing section 47. The reference level determination means 49 determines which level range, among a plurality of predetermined reference level ranges, the speed detected by the speed sensor 45 belongs to. The reference level determination means 49 outputs the determination result to the image capturing condition changing means 51. In the present embodiment, the plurality of reference level ranges are grouped into two ranges, a higher reference level range for high speeds and a lower reference level range for low speeds.

The image capturing condition changing means 51 changes at least the frame rate of the video camera 17 in accordance with the determination result outputted from the reference level determination means 49. How the image capturing condition changing means 51 changes the frame rate is arbitrary. In the present embodiment, the image capturing condition changing means 51 changes the frame rate when the speed detected by the speed sensor 45 comes to belong to the higher reference level range than the previous reference level range so that the frame rate may be increased from that for the previous lower reference level range. Here, the frame rates for the respective reference level ranges, which are changed by the image capturing condition changing means 51, are defined so that an image displayed on the display screen 7 of the video display device 55 may not make viewers feel something strange. Specifically, the frame rate for the higher reference level range is defined as 30 fps, and defined as 7.5 fps for the lower reference level range. However, it is not limited to the above settings. When the frame rate is changed, a refresh rate of the video display device 55 is also changed in synchronization with the changed frame rate. In the present embodiment, the refresh rate is changed by the dedicated controller 9. The data that the frame rate has been changed is transmitted to the dedicated controller 9 from the signal transmission device 43, together with a video signal.

The video camera 17 captures an object under an image capturing condition that has been changed by the video camera controller 41, converts the object data into a video signal, and outputs the video signal to the signal transmission device 43. The signal transmission device 43 transmits the video signal via the antenna 21 to the dedicated controller 9, which is equipped with the video display device 55. In the present embodiment, the signal transmission device 43 includes the resolution changing means 53. The resolution changing means 53 changes the video signal resolution in accordance with the reference level range determined by the reference level determination means 49. Specifically, the resolution changing means 53 changes the resolution by decreasing the video signal resolution when the frame rate is increased and by increasing the resolution when the frame rate is decreased. In this manner, even when the frame rate is increased, the data volume to be transmitted is suppressed by decreasing the video signal resolution. That can prevent the size of data transmitted by the signal transmission device 43 from becoming too large, thereby contributing to reducing power consumption. When the frame rate is high, a display time per frame becomes shorter than when the frame rate is low. Accordingly, if the frame rate is high, viewers rarely feel something strange even when the video signal resolution is low or the image is somewhat coarse. According to the present embodiment, although the resolution changing means 53 is disposed in the signal transmission device 43 for the purpose of changing the resolution of video signals to be transmitted, it is not always necessary to change the resolution, of course. Further, if the resolution of images captured by the video camera 17 is adjustable, the video camera controller 41 may be configured to be capable of changing the resolution of the images captured by the video camera 17. The video display device 55 mounted on the dedicated controller 9 displays an image on the display screen 7 (FIG. 1) based on the video signal received via an antenna 39.

In the present embodiment, the traveling toy carrier device 5 includes the charging device 57 and the output electrodes 59. The traveling toy 3 includes the charging electrodes 61 (collector brushes 25), the charging circuit 63, and the electric storage means for power supply 65. The charging device 57 supplies electric power to the traveling toy 3 via the output electrodes 59. The configuration of the charging device 57 is arbitrary as far as it can supply direct current power for charging the electric storage means for power supply 65. In the present embodiment, the output electrodes 59 are constituted from the above-mentioned pair of power supply rails 33 disposed on the carrier portion 5A of the traveling toy carrier device 5. When the charging electrodes 61 (collector brushes 25) are in contact with the output electrodes 59, electric power for charging is supplied to the charging circuit 63 of the traveling toy 3 from the charging device 57. The charging circuit 63 charges the electric storage means for power supply 65 under a voltage applied to the charging electrodes 61. The type of the electric storage means for power supply 65 is arbitrary as far as it can supply electric power at least to the video camera 17, the signal transmission means 43, and the video camera controller 41. It may be any of a primary battery, a secondary battery, and a capacitor. In the present embodiment, the electric storage means for power supply 65 is constituted from an electric double-layer capacitor whose charging time is comparatively short. Accordingly, the traveling toy system does not have to stop its operation for charging the electric storage means for power supply 65. In addition, according to the present embodiment, since the electric storage means for power supply 65 can be charged whenever the traveling toy 3 is being carried by the traveling toy carrier device 5, it becomes possible to use the electric double-layer capacitor as the electric storage means for power supply 65, even though its capacitance is small.

In the present embodiment, video signals are transmitted and received wirelessly using a radio wave signal. However, wired transmission/reception of the video signals is also available by providing the traveling lane 15 with a conductive rail, which is capable of transmitting the video signals, and connecting the conductive rail to the video display device via a cable or the like. When the dedicated controller 9 can control the operation of the traveling toy 3, the system can be configured in such a manner that the antenna 21 receives a control signal transmitted from the dedicated controller, then the received control signal is processed in the signal processing circuit to control the operation of the traveling toy 3.

The video display device 55 which displays a video signal on the display screen 7 is mounted in the dedicated controller 9. The antenna 39 (FIG. 1) for transmitting/receiving a signal to/from the traveling toys 3 is also mounted onto the dedicated controller 9. The video display device 55 receives the video signal from the traveling toy 3 via the antenna 39, and displays an image on the display screen 7 based on the received video signal.

Figure 6:
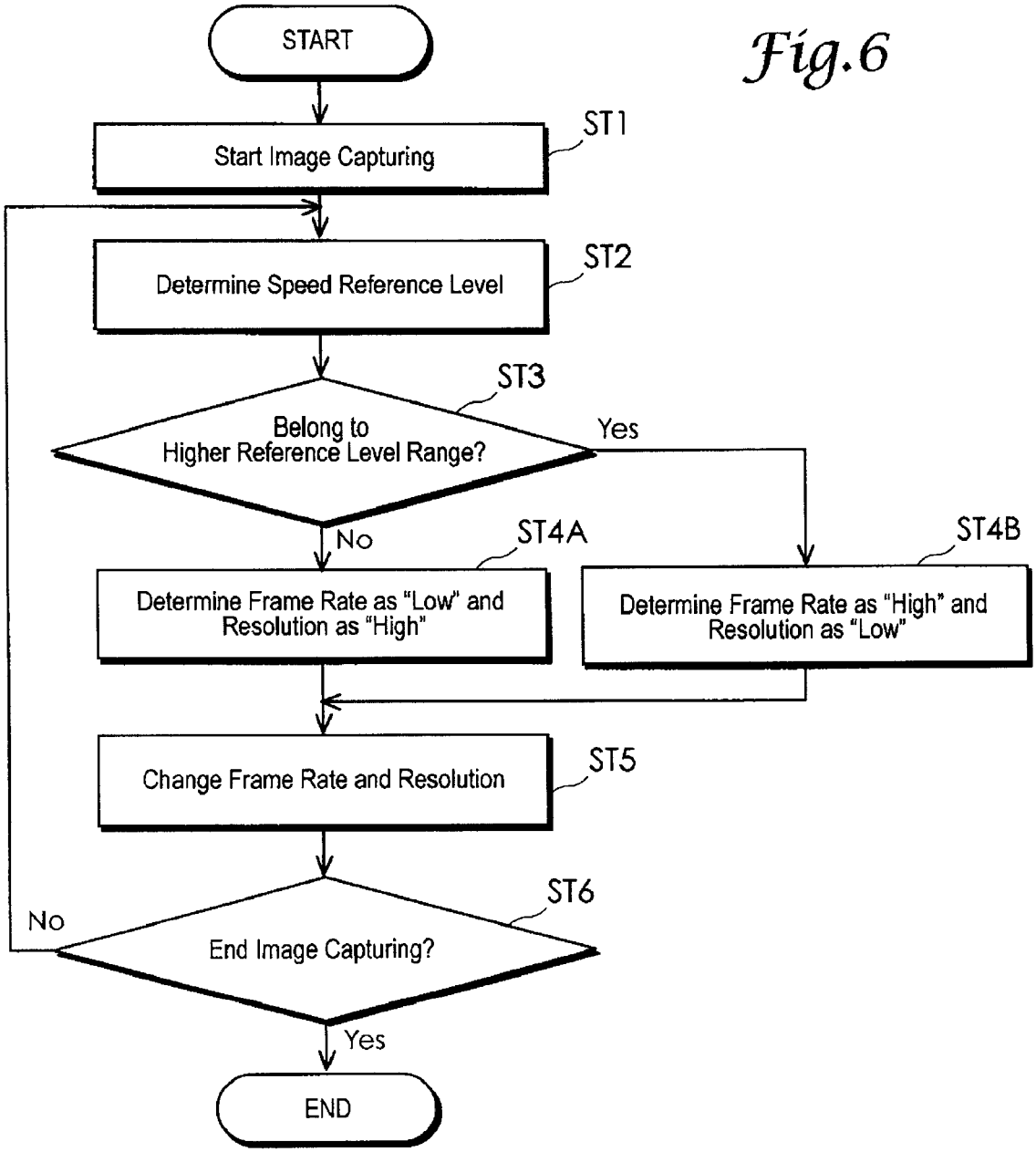
FIG. 6 is a flow chart showing a program algorithm used for implementing the signal processing circuit of FIG. 5.

FIG. 6 is a flow chart showing an example of software algorithm executed by microcomputer for implementing a principal portion of the signal processing circuit of FIG. 5. In the flow chart, the video camera 17 of the traveling toy 3 starts image capturing in step ST1. The captured image is converted into a video signal and transmitted to the dedicated controller 9. The video display device 55 of the dedicated controller 9 displays an image on the display screen 7 based on the received video signal. In step ST2, the traveling speed of the traveling toy 3 is detected and a reference level of the traveling speed is determined. If it is determined in step ST3 that the traveling speed belongs to a higher reference level range (Yes), the video camera controller 41 determines the frame rate of images available with the video camera 17 to be "high" in step ST4B as shown in the table of FIG. 7. Meanwhile, the resolution changing means 53 of the signal transmission apparatus 43 determines the resolution of the video signal transmitted to the dedicated controller 9 to be "low". If it is determined in step ST3 that the traveling speed belongs to a lower reference level range (No), the video camera controller 41 determines the frame rate of images available with the video camera 17 to be "low" in step ST4A. Meanwhile, the resolution changing means 53 of the signal transmission apparatus 43 determines the resolution of the video signal transmitted to the dedicated controller 9 to be "high". In step ST5, the image capturing condition changing means 51 and the resolution changing means 53 change the frame rate and resolution in accordance with the frame rate and resolution determined in steps ST4A and ST4B. In step ST6, it is determined whether or not the image capturing should be ended by operating the dedicated controller 9 or the like. If it is determined that the image capturing is not ended (No), it returns to step ST2 and the traveling speed of the traveling toy 3 is detected again to determine the reference level. If it is determined that the image capturing should be ended, the image capturing is then ended in step ST6. The above-mentioned algorithm may be just an example and other algorithms are also available.

Figure 8:
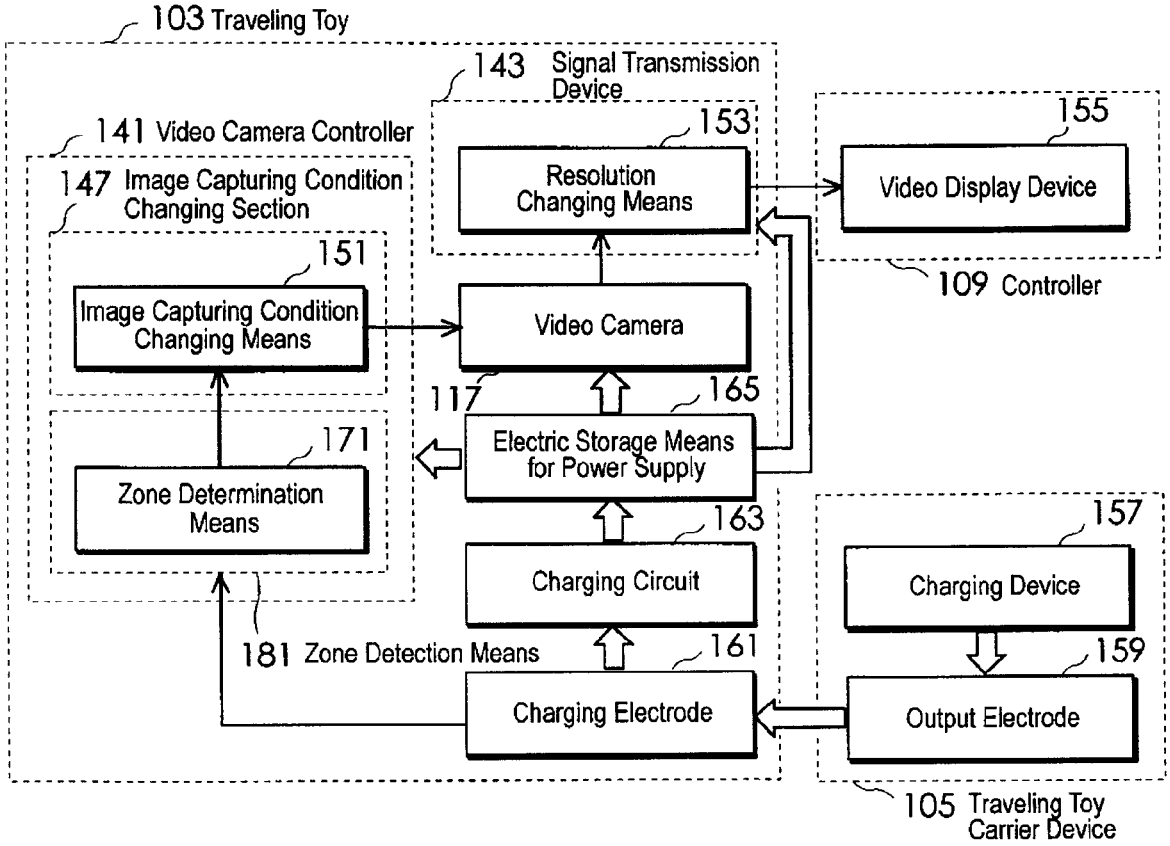
FIG. 8 is a block diagram partially showing another example configuration of a signal processing circuit and a flow of electric power according to the embodiment of FIG. 1.

FIG. 8 is a block diagram partially showing another example configuration of a signal processing circuit and a processing flow thereof according to a second embodiment. FIG. 8 is different from FIG. 5 in that a video camera controller 141 includes zone determination means 171 for detecting a high speed zone in which the traveling speed of a traveling toy 103 is higher than a given speed and a low speed zone in which the traveling speed is lower than the given speed, based on a position of the traveling toy 103 traveling on a traveling lane 115, instead of the speed sensor 45 and the reference level determination means 49. In FIG. 8, portions similar to those of the first embodiment shown in FIG. 5 have their reference numerals calculated by adding a number 100 to the corresponding reference numerals indicated in FIG. 5, and their detailed descriptions will be omitted. According to the present embodiment, zone detection means 181 includes the zone determination means 171 which detects whether the traveling toy 103 is traveling in the high seed zone or the low speed zone by determining whether or not charging electrodes 161 (collector brushes) of the traveling toy 103 are in contact with output electrodes 159 of a charging device 157 or other electrodes indicative of the low speed zone (not shown), which are disposed in another low speed zone of the traveling lane 115. Although depending on the design of the traveling lane 115, another low speed zone, in which the traveling speed of the traveling toy is lower than the given speed when the traveling toy 103 is traveling down from a position where the potential energy is the maximum only by means of the potential energy, is formed in the traveling lane 115 besides a carrier portion 105A, in which the traveling toy 103 is carried by a traveling toy carrier device 105. Thus in order to detect such low speed zone other than the carrier portion 105A, rail-like electrodes indicative of low-speed zone are disposed on the traveling surface corresponding to the low speed zone of the traveling lane 115 so that the rail-like electrodes indicative of low-speed zone can apply voltage to the charging electrodes 161 (collector brushes) by being in contact with the charging electrodes 161. It is not necessary to apply the voltage enough for charging to the electrodes indicative of low-speed zone, and it is enough to apply just a detectable level of voltage. Then, the zone determination means 171 determines a zone, in which it is detected that the charging electrodes 161 are in contact with the electrodes indicative of low-speed zone or the output electrodes 159 of the traveling toy carrier device 105, as the low speed zone and determines the other zones as the high speed zone. The charging electrodes 161 charge electric storage means for power supply 165 via charging circuit 163 by being in contact with the output electrodes 159 disposed on the traveling surface of the traveling toy carrier device 105 when the traveling toy 103 enters the traveling toy carrier device 105. At this time, the zone determination means 171 included in the video camera controller 141 determines that the traveling toy 103 is traveling on the low speed zone because the charging electrodes 161 are in contact with the output electrodes 159, then outputs the determination result to image capturing condition changing means 151. As well, when the charging electrodes 161 are in contact with the above-mentioned electrodes indicative of low-speed zone, the zone determination means 171 determines that the traveling toy 103 is traveling on the low speed zone, then outputs the determination result to the image capturing condition changing means 151. The image capturing condition changing means 151 changes the frame rate of a video camera 117 in accordance with the determination result outputted from the zone determination means 171. The frame rate to be changed by the image capturing condition changing means 151 is defined so that an image displayed on a video display device 155 may not make viewers feel something strange.

Figure 9:
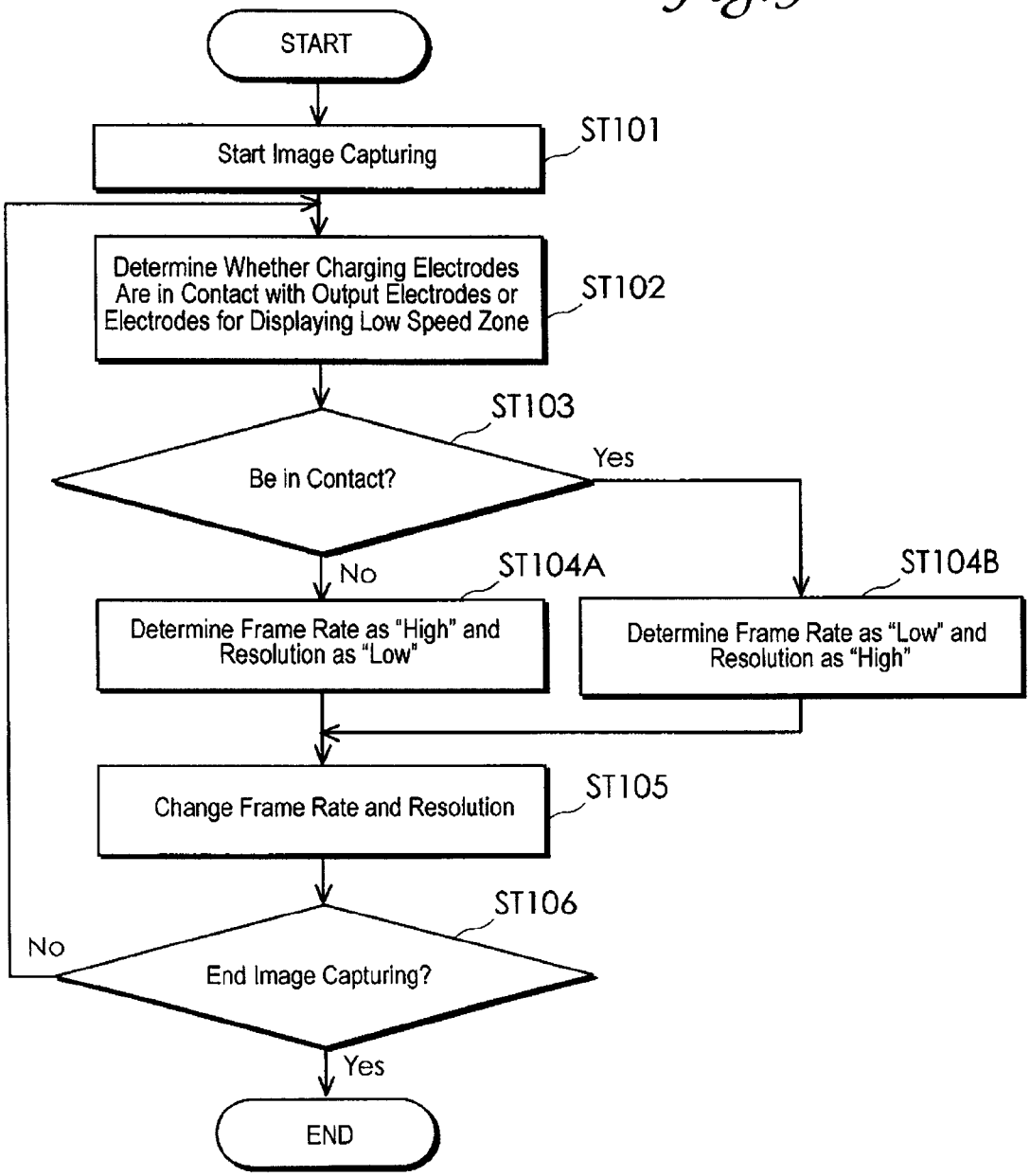
FIG. 9 is a flow chart showing a program algorithm used for implementing the signal processing circuit of FIG. 8.

FIG. 9 is a flow chart showing an example of software algorithm executed by microcomputer for implementing the signal processing circuit of FIG. 8. First, the video camera 117 of the traveling toy 103 starts image capturing in step ST101. Then an image captured is converted into a video signal and transmitted to a dedicated controller 109. The video display device 155 of the dedicated controller 109 displays the image on a display screen 107 based on the received video signal. In step ST102, it is detected whether or not the charging electrodes 161 are in contact with the output electrodes 159 or the electrodes indicative of low-speed zone so as to determine whether the traveling toy 103 is traveling on the high speed zone or the low speed zone. If it is determined in step ST103 that the charging electrodes 161 are not in contact with the output electrodes 159 or the electrodes indicative of low-speed zone (No), it is determined that the traveling toy is traveling on the high speed zone, and the video camera controller 141 determines the frame rate of the image captured by the video camera 117 to be "high" in step ST104A. Meanwhile, resolution changing means 153 of a signal transmission apparatus 143 determines the resolution of the video signal transmitted to the dedicated controller 109 to be "low." If it is determined in step ST103 that the charging electrodes 161 are in contact with the output electrodes 159 or the electrodes indicative of low-speed zone (Yes), the video camera controller 141 determines the frame rate of the image captured by the video camera 117 to be "low" in step ST104B. Meanwhile, the resolution changing means 153 of the signal transmission apparatus 143 determines the resolution of the video signal transmitted to the dedicated controller 109 to be "high". In step ST105, the image capturing condition changing means 151 and the resolution changing means 153 change the frame rate and resolution in accordance with the frame rate and resolution determined in steps ST104A and ST104B. In step ST106, it is determined whether or not the image capturing should be ended by operating the dedicated controller 9 or the like. If it is determined that the image capturing should not be ended, it returns to step ST102 and it is detected again whether or not the charging electrodes 161 of the traveling toy are in contact with the output electrodes 159 or the electrodes indicative of low-speed zone so as to determine whether the traveling toy is traveling in the high speed zone or the low speed zone. If the image capturing should be ended, the image capturing is ended in step ST106. The above-mentioned algorithm may be just an example and other algorithms are also available.

Figure 10:
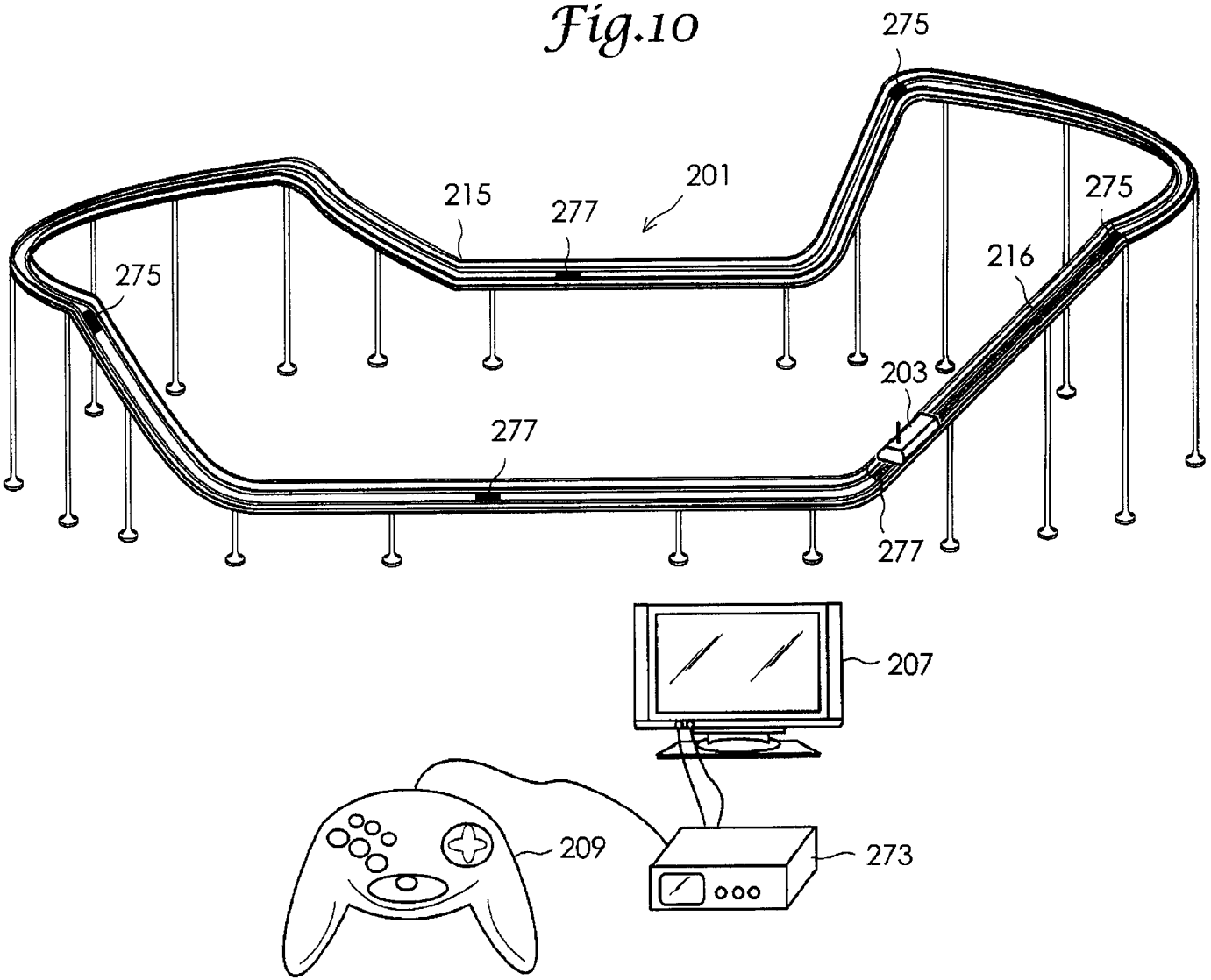
FIG. 10 shows a traveling toy system according to another embodiment of the present invention.
Figure 11A:
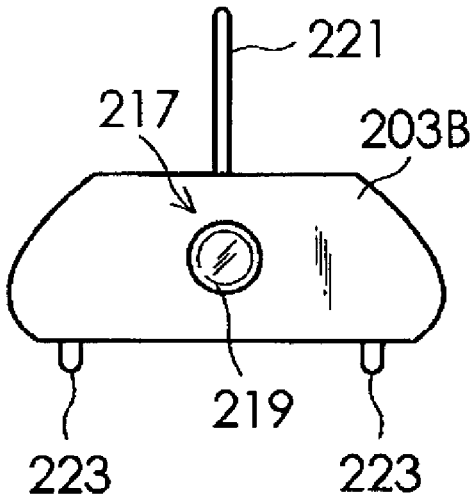
FIGS. 11A to 11D are a front elevation view, a right side elevation view, a bottom view, and a perspective view of a traveling toy which may used in the embodiment of FIG. 10.
Figure 11B:
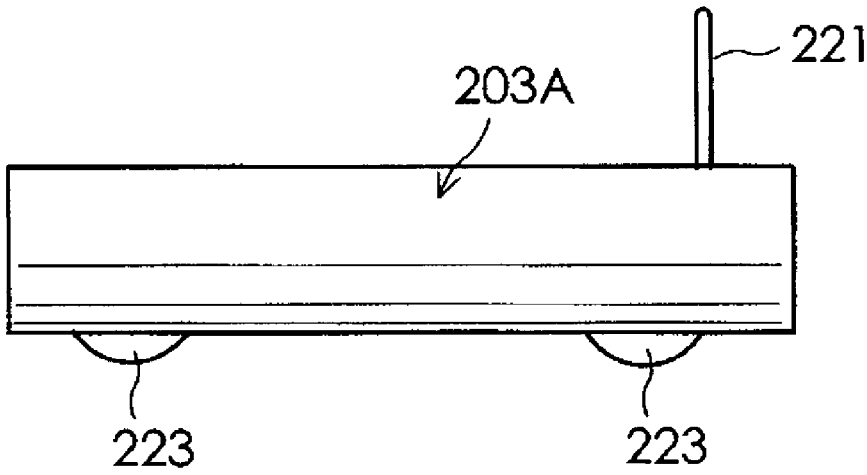
Figure 11C:
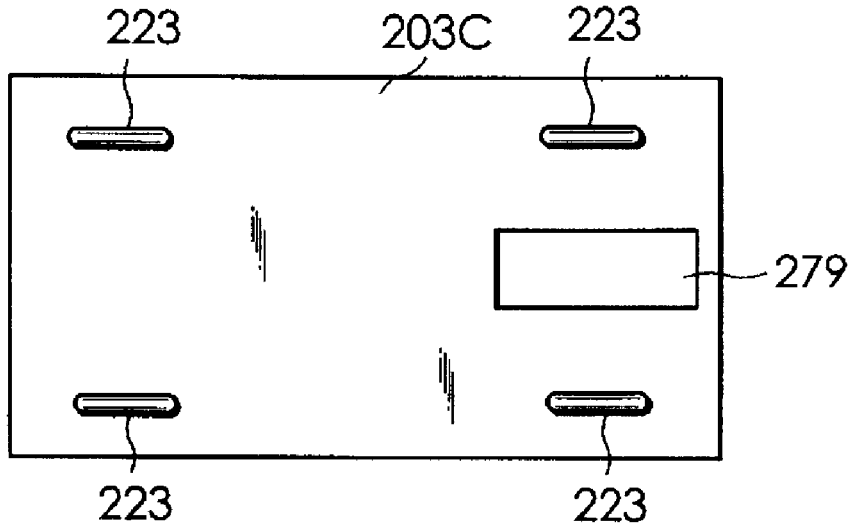
Figure 11D:
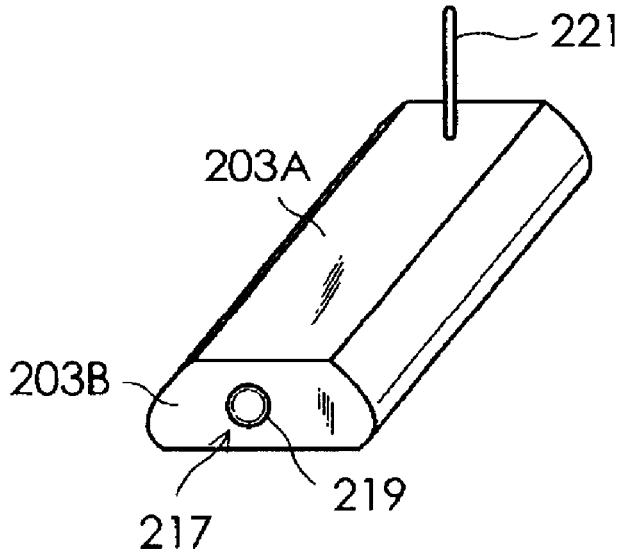
Figure 12:
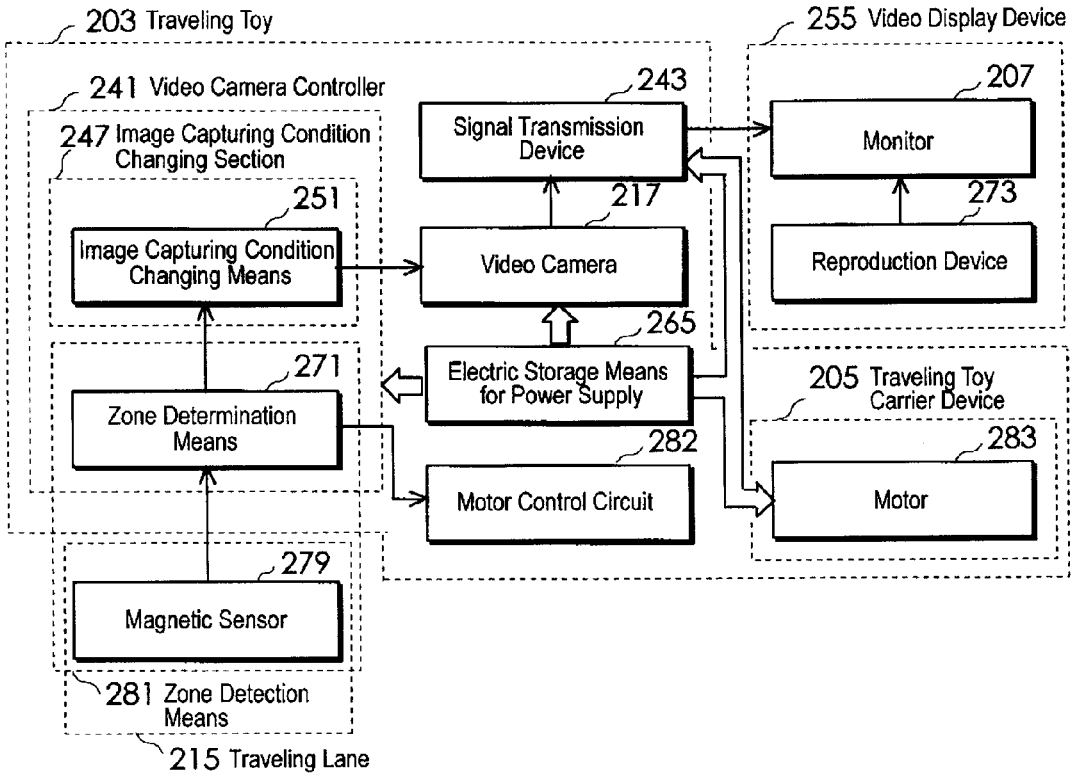
FIG. 12 is a block diagram partially showing an example configuration of a signal processing circuit and a flow of electric power according to the embodiment of FIG. 10.

FIG. 10 shows a configuration of a traveling toy system according to a third embodiment. FIGS. 11A to 11D are a front elevation view, a side elevation view, a bottom view, and a perspective view of a battery-built-in and self-activated traveling toy 203 according to the third embodiment. FIG. 12 is a block diagram showing a configuration of a signal processing circuit according to the third embodiment. In FIGS. 10 to 12, portions similar to those of the first embodiment shown in FIGS. 1 to 5 have their reference numerals calculated by adding a number 200 to the corresponding reference numerals shown in FIGS. 1 to 5, and their detailed descriptions will be omitted. In the present embodiment, a video display device 255 includes a reproduction device 273 which receives and reproduces a video signal and a general-purpose monitor 207 equipped with a display screen. Here, what is called home vide-game device is employed as the reproduction device 273. Permanent magnets 275 and 277 are disposed on a traveling lane 215 so as to work as a zone identification portion for identifying a high speed zone. The permanent magnets 275 and 277 are disposed on both ends of the high speed zone or a low speed zone. In the present embodiment, the North pole permanent magnets 275 are embedded in the start points of two high speed zones respectively constituted from a downward slope and a flat-lane portion connected continuously to the downward slope, and the South pole permanent magnets 277 are embedded in the end points of the two high speed zones respectively. A traveling toy carrier device 205 of the present embodiment is constituted from a motor 283 disposed inside the traveling toy 203. An electric storage means for power supply 265 is constituted from a non-rechargeable primary battery such as a dry cell.

In the present embodiment, as shown in FIG. 11, the traveling toy 203 has a magnetic sensor 279, which is constituted from a hall element to detect the presence of magnetic poles (North/South poles) of the permanent magnets 275 and 277 embedded in the traveling lane 215 as described above in such a manner that the magnetic sensor 279 is partially exposed from a bottom face 203C of a toy body portion 203A of the traveling toy 203. Zone determination means 271 determines that a position at which the North pole permanent magnet 275 is detected is the start point of the high speed zone and that a position at which the South pole permanent magnet 277 is detected is the end point of the high speed zone, based on an output of the magnetic sensor 279. The South pole permanent magnet 277 is fixedly embedded in the start point of an uphill slope 216 and the North pole permanent magnet 275 is fixedly embedded in the end point of the uphill slope 216 so that the zone determination means 271 can detect the uphill slope 216 and outputs a signal to a motor control circuit 282 to tell that it is an area to drive the motor. In this configuration, the zone determination means 271 may follow the criterion that when the South pole permanent magnet is detected twice in a row, it is determined to be the start point of the uphill slope. The motor control circuit 282 continues to output a driving signal to a drive circuit contained in the motor 283 to drive the motor 283 while the traveling toy 203 is traveling from the start point to the end point of the uphill slope. After the traveling toy 203 arrives at the top of the uphill 216, the drive of the motor 283 is stopped and a wheel 223 of the motor 283 rotates freely, released from the motor-driven control. Accordingly, hereinafter, the wheel 223 rotates by friction by means of the potential energy so that the traveling toy 203 can travel on a downward slope portion of the traveling lane 215. Whether or not the traveling toy 203 has arrived at the top of the uphill slope can be determined by detecting the North pole permanent magnet 275.

Image capturing condition changing means 251 shown in FIG. 12 changes the frame rate and resolution of a video camera 217 while the zone determination means 271 is detecting the high speed zone. The frame rate to be changed by the image capturing condition changing means 251 is defined so that an image displayed on the video display device 255 may not make viewers feel something strange as with Embodiments 1 and 2. The video display device 255 reproduces a video signal received by the reproduction device 273 as an image and displays it on the monitor 207.

In the above-mentioned third embodiment, although the permanent magnet is used as the zone identification portion, it is also possible to dispose a light reflection member typically in the high speed zone of the traveling lane 215 for example instead of the permanent magnets so as to distinguish the high speed zone from the low speed zone by detecting the presence of the light reflection member. In this configuration, a light-emitting element which emits light to the traveling lane and a light-receiving element which receives the light reflected by the light reflection member are mounted on the traveling toy. With such configuration, the zone determination means determines that the traveling toy is traveling in a particular zone when the light-receiving element is receiving the light reflected by the light reflection member. To detect an uphill slope zone or the zone from the start point to the end point of the uphill, it may be designed so as to dispose the light reflection members at intervals in the uphill slow zone so that users can know that it is not only the low speed zone but also the uphill slope by recognizing the reflection members disposed at intervals. How to dispose the light reflection member is arbitrary, and how to determine the zone determination means using the light reflection member is also arbitrary.

FIG. 13 is a flow chart showing a software algorithm executed by microcomputer to implement a main portion of the signal processing circuit of FIG. 12. First, the video camera 217 of the traveling toy 203 starts image capturing in step ST201. The captured image is then converted into a video signal and transmitted to the reproduction device 273, and the reproduction device 273 displays an image on the monitor 207 based on the received video signal. In step ST202, it is determined whether or not a particular zone is detected by the zone determination means 271, based on the presence of the permanent magnets 275 and 277. If the particular zone is not detected (No), it returns to step ST202 in step ST203. In step ST204, it is determined whether or not the current image capturing condition is to be set as the one for the high speed zone with reference to the detected particular zone. If the image capturing is done with the image capturing condition for the high speed zone (Yes), it is determined that the traveling toy has entered the high speed zone. Accordingly, in step ST205A, the video camera controller 241 determines the frame rate of an image captured by the video camera 217 to be "high" and determines the resolution to be "low" in order to change the image capturing condition to be appropriate for the high speed zone. If the image capturing is done with the image capturing condition for the low speed zone (No), the video camera controller 241 determines the frame rate of an image captured by the video camera 217 to be "low" and determines the resolution to be "high" in step ST205B. In step ST206, the image capturing condition changing means 251 changes the frame rate and resolution of an image captured by the a video camera in accordance with the frame rate and resolution determined in step ST205A or step ST205B. In step ST207, it is determined whether or not the image capturing should be ended. If it is determined that the image capturing should not be ended (No), the process returns to step ST202 and it is again determined whether or not the presence of the permanent magnet is detected. If the image capturing should be ended, the image capturing is thus ended in step ST207. The above-mentioned algorithm is just an example and other algorithms may also be available. When the light reflection member instead of the permanent magnet is disposed on the traveling lane, it is determined in step ST202 whether or not the light-receiving element has detected the reflected light.

Figure 14A:
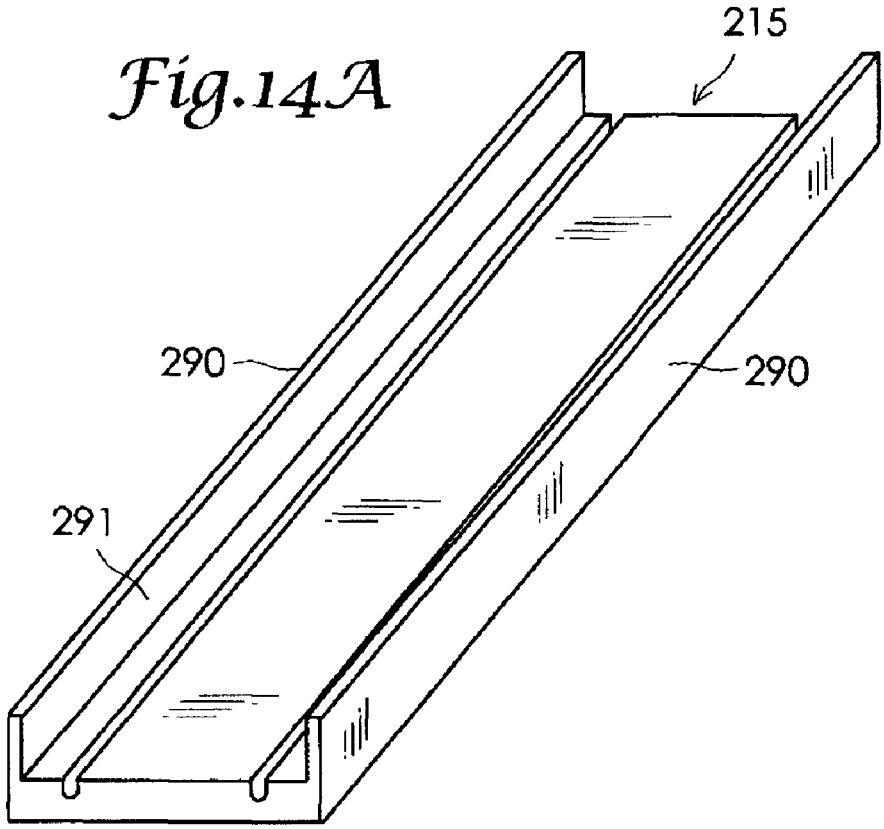
FIGS. 14A and 14B explain an example in which sidewalls are formed along a traveling lane and the inner wall surfaces are colored differently from the traveling lane so that it can be detected whether a traveling toy is traveling in a high speed zone or a low speed zone by recognizing the color viewed in an image captured by the video camera.
Figure 14B:
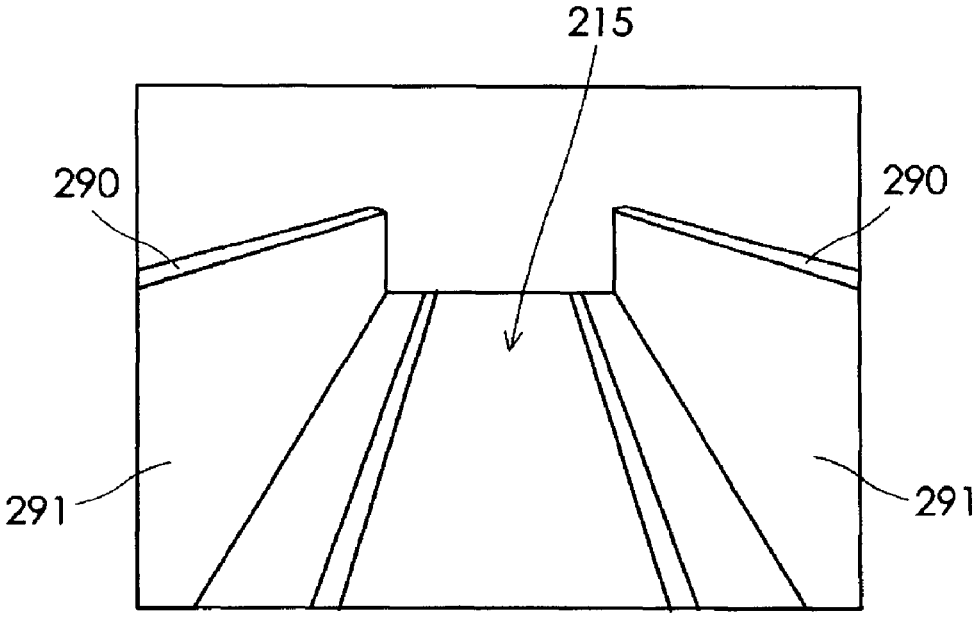

FIG. 14A shows a part of an example configuration of a traveling lane, which is used when it is determined whether a traveling toy is traveling in a high speed zone or a low speed zone by means of image recognition using an image captured by the video camera. Here in FIG. 14A, sidewalls 290 are formed in a part of the traveling lane 215, and inner wall surfaces 291 are colored differently from the traveling lane 215. The sidewalls 290 are provided only in the low speed zone. In the present embodiment, for example, the sidewalls 290 are always formed in a zone from a position in which the potential energy is low to a position in which the potential energy is high, that is, a zone in which the traveling toy carrier device works because that is the low speed zone. FIG. 14B shows an image which is captured by the video camera and displayed when the traveling toy is traveling in the low speed zone in the present embodiment. As shown in FIG. 14B, when the traveling toy is traveling on the low speed zone, an image captured by the video camera shows the inner wall surfaces 291 of the right and left sidewalls 290 colored differently from the traveling lane. Accordingly, it is possible to determine whether the traveling toy is traveling in the high speed zone or the low speed zone by detecting whether or not the image captured by the video camera includes the color of the inner wall surfaces 291.

Figure 15A:
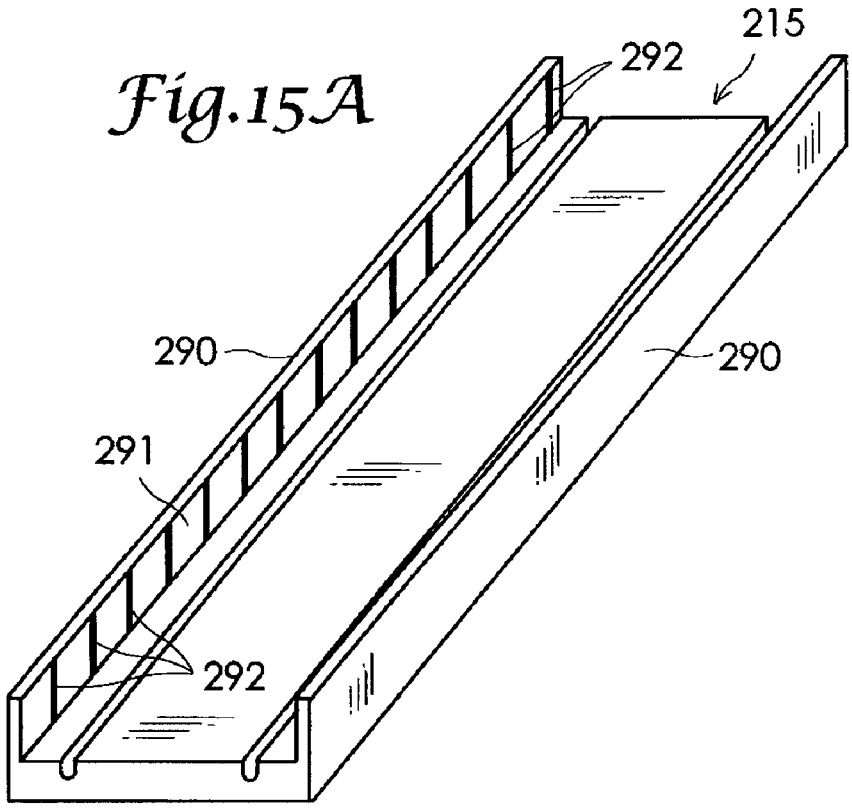
FIGS. 15A and 15B explain an example in which sidewalls are formed along the traveling lane and mark indicators are shown on the inner wall surfaces so that it can be detected whether the traveling toy is traveling in the high speed zone or the low speed zone by recognizing the mark indicators viewed in an image captured by the video camera.

In FIG. 14A, the sidewalls 290 are formed in a part of the traveling lane 215 and inner wall surfaces 291 are colored differently from the traveling lane 215. In another example of FIG. 15A, mark indicators 292 such as a line are put on the inner wall surfaces 291 at a given interval.

Figure 15B:
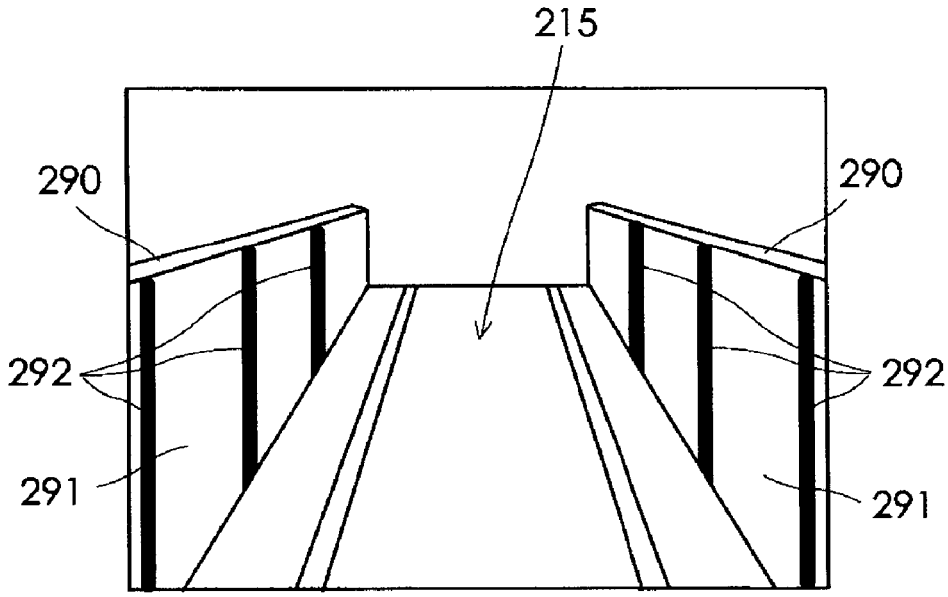

FIG. 15B shows an example of an image captured by the video camera. In this configuration, what is necessary is that the zone determination means includes image recognition means capable of detecting the presence of the mark indicator 292, based on a video signal of the video camera. The image recognition means determines whether or not the transmitted video signal includes the mark indicator 292, and outputs the determination result to the zone determination means.

The zone determination means determines whether the traveling toy is traveling in the high speed zone or the low speed zone of the traveling lane, based on the output of the image recognition means. In the present embodiment, although the mark indicators 292 are provided in the low speed zone, they may be provided in the high-speed zone. If it can be determined whether the traveling toy is traveling in the high speed zone or the low speed zone by means of image recognition as described above, no sensor element is required.

Although some preferred embodiments of the present invention have been described with reference to drawings, it may be obvious that within the scope of the above-mentioned teachings many modifications and variations are possible. It is therefore to be understood that within the scope of the appended claims the invention may be practiced otherwise than as specifically described.

What is claimed is:

1. A traveling toy system comprising:

a traveling toy which travels on a traveling lane using a potential energy;

a traveling toy carrier device which carries the traveling toy from a position where the potential energy is low to a position where the potential energy is high;

a video camera mounted on the traveling toy;

a video camera controller which is mounted on the traveling toy and adjustably controls at least a frame rate of the video camera;

a signal transmission device which is mounted on the traveling toy and transmits a video signal outputted from the video camera to a video display device; and electric storage means for power supply, which is mounted on the traveling toy, wherein the video camera controller changes the frame rate so that when a traveling speed of the traveling toy is higher than a given speed, the frame rate may be increased from the frame rate at the time that the traveling speed is lower than the given speed.

2. The traveling toy system according to claim 1, wherein the video camera controller includes a speed sensor which detects the traveling speed of the traveling toy and an image capturing condition changing section which changes the frame rate in accordance with an output of the speed sensor;

the image capturing condition changing section includes reference level determination means for determining which level range, among a plurality of predetermined reference level ranges, the speed detected by the speed sensor belongs to; and image capturing condition changing means for changing the frame rate in accordance with a determination made by the reference level determination means; and the image capturing condition changing means changes the frame rate when the speed detected by the speed sensor comes to belong to a higher reference level range than the previous reference level range so that the frame rate may be increased from that for the previous lower reference level range.

3. The traveling toy system according to claim 2, wherein the frame rates for the plurality of reference level ranges are defined so that an image displayed on the video display device may not make viewers feel something strange.

4. The traveling toy system according to claim 1, further comprising zone detection means for detecting a high speed zone in which the traveling speed of the traveling toy is higher than the given speed and a low speed zone in which the traveling speed is lower than the given speed, based on a position of the traveling toy traveling on the traveling lane, wherein the zone detection means includes a zone identification portion which is disposed on the traveling lane and identifies either of the high speed zone or the low speed zone, and zone determination means which is mounted on the video camera controller for determining whether or not the traveling toy is traveling within the zone identified by the zone identification portion; and the video camera controller further includes an image capturing condition changing section which determines whether or not the traveling speed of the traveling toy is higher than the given speed in accordance with the zone determined by the zone determination means, and changes the frame rate.

5. The traveling toy system according to claim 4, wherein the zone identification portion is constituted from two or more permanent magnets disposed on at least both ends of the high speed zone or the low speed zone; and the zone determination means includes a hall element which detects the presence of the two or more permanent magnets, and determines whether the traveling toy is traveling in the high speed zone or the low speed zone of the traveling lane, based on an output of the hall element.

6. The traveling toy system according to claim 4, wherein the zone identification portion is constituted from two or more light reflection members disposed on at least both ends of the high speed zone or the low speed zone; and the zone determination means includes a light-emitting element which emits light to the traveling lane and a light-receiving element which receives the light reflected by the light reflection member to detect the presence of the two or more light reflection members, and determines whether the traveling toy is traveling in the high speed zone or the low speed zone of the traveling lane, based on an output of the light-receiving element.

7. The traveling toy system according to claim 4, wherein the zone identification portion is constituted from a mark indicator disposed in the high speed zone and/or the low speed zone of the traveling lane; and the zone determination means includes image recognition means for recognizing the presence of the mark indicator, based on the video signal transmitted from the video camera, and determines whether the traveling toy is traveling in the high speed zone or the low speed zone of the traveling lane, based on an output of the image recognition means.

8. The traveling toy system according to claim 4, wherein the frame rates for the high speed zone and the low speed zone are defined so that an image displayed on the video display device may not make viewers feel something strange.

9. The traveling toy system according to claim 1, wherein the signal transmission device includes resolution changing means for changing a resolution of the video signal in accordance with the frame rate; and the resolution changing means changes the resolution by decreasing the resolution of the video signal when the frame rate is increased and by increasing the resolution when the frame rate is decreased.

10. The traveling toy system according to claim 1, wherein the video camera controller is capable of changing the resolution of the video camera; and the image capturing condition changing means changes the resolution of the video camera so that when the traveling speed of the traveling toy is higher than the given speed, the resolution may be decreased from the resolution at the time that the traveling speed of the traveling toy is lower than the given speed.

11. The traveling toy system according to claim 1, wherein the traveling toy carrier device includes a charging device which supplies electric power for charging the electric storage means for power supply while carrying the traveling toy to the position where the potential energy is high; and the traveling toy includes charging electrodes and a charging circuit, wherein the charging electrodes are connected to output electrodes of the charging device, and the charging circuit charges the electric storage means for power supply with electric power supplied from the charging device while the traveling toy is being carried by the traveling toy carrier device.

12. The traveling toy system according to claim 11, further comprising zone detection means for detecting a high speed zone in which the traveling speed of the traveling toy is higher than the given speed and a low speed zone in which the traveling speed is lower than the given speed, based on a position of the traveling toy traveling on the traveling lane, wherein the zone detection means includes zone determination means which is mounted on the video camera controller for detecting whether the traveling toy is traveling in the high speed zone or the low speed zone by determining whether or not the charging electrodes of the traveling toy are connected to the output electrodes of the charging device; and the video camera controller further includes an image capturing condition changing section which determines whether or not the traveling speed of the traveling toy is higher than the given speed in accordance with the zone determined by the zone determination means, and changes the frame rate.

13. The traveling toy system according to claim 1, wherein the traveling lane is continuously formed between an entrance portion and an exit portion of the traveling toy carrier device so as to allow the traveling toy to start traveling from the exit portion and return to the entrance portion only by means of the potential energy.

14. The traveling toy system according to claim 1, further comprising a dedicated controller on which the video display device is mounted.

15. The traveling toy system according to claim 1, wherein the video display device includes a monitor and a reproduction device which reproduces the video signal on the monitor.

* * * * *